US005941115A

United States Patent [19]

Minnerop et al.

[11] Patent Number: 5,941,115

[45] Date of Patent: Aug. 24, 1999

[54] ROLLING TRAIN

[75] Inventors: Michael Minnerop, Ratingen; Hans-Jürgen Reismann, Düsseldorf, both of Germany

[73] Assignee: SMS Schloemann-Siemag Aktiengesellschaft, Dëesseldorf, Germany

[21] Appl. No.: 09/006,706

[22] Filed: Jan. 14, 1998

[30] Foreign Application Priority Data

Jan. 16, 1997 [DE] Germany ..... 197 01 235

[51] Int. Cl.[6] ..... B21B 31/00; B21B 31/08

[52] U.S. Cl. ..... 72/239; 72/238

[58] Field of Search ..... 72/238, 239, 237, 72/234

[56] References Cited

U.S. PATENT DOCUMENTS 3,949,586 4/1976 Neumann ..... 72/238

FOREIGN PATENT DOCUMENTS 0329998 8/1989 European Pat. Off. .

*Primary Examiner*—Rodney Butler

*Attorney, Agent, or Firm*—Friedrich Kueffner

[57] ABSTRACT

A rolling train, particularly tandem stand group, includes roll stands, particularly two universal stands and an edging stand arranged between the universal stands, wherein the roll stands are each equipped with guide fittings, and wherein the rolling train further includes a shifting platform arranged on the operator side and an exchange carriage moveable for changing rolls. The guide fittings are connected to the roll sets and can be moved out of the rolling line as a unit together with the roll housings on the operator side of the three roll stands.

4 Claims, 4 Drawing Sheets

ROLLING TRAIN

BACKGROUND OF THE INVENTION

1. Field of the Invention

The present invention relates to a rolling train, particularly tandem stand group, composed of roll stands, particularly two universal stands and an edging stand arranged between the universal stands, wherein the roll stands are each equipped with guide fittings, and wherein the rolling train further includes a shifting platform arranged on the operator side and an exchange carriage moveable for changing rolls.

2. Description of the Related Art

In a rolling train of the above-described type disclosed in EP 0 329 998 B 1, which includes two stationary universal roll stands and an edging stand arranged between the universal roll stands, the middle stand, i.e., the edging stand and, thus, the smallest stand of the rolling train, is shifted out of the rolling line toward the operator side for mechanizing the roll and fitting exchange. As soon as the edging stand assumes a position outside of the narrow space available between the two heavy universal stands, the edging stand is easily accessible from all sides, so that the guide fittings can be exchanged without problems. Simultaneously, shifting of the edging stand results in a sufficiently large free space between the universal stands in which assembly and disassembly devices can be used, so that the guide fittings of the universal stands can also be exchanged.

However, in this known rolling train, separate shifting platforms and work platforms are required for the roll sets as well as for the guide armatures to be exchanged, so that intersecting travel paths exist. In addition, for changing the roll sets, a shop crane or auxiliary crane is required, wherein the use of this crane may endanger the personnel.

SUMMARY OF THE INVENTION

Therefore, it is the primary object of the present invention to provide a rolling train of the above-described type, for example, a continuous train or tandem stand group, in which the exchange of replacement units is simpler and can be carried out with fewer individual movements, and in which the exchange is safer.

In accordance with the present invention, the guide fittings are connected to the roll sets and can be moved out of the rolling line as a unit together with the roll housings on the operator side of the three roll stands.

Consequently, by utilizing the conventional displacement of the roll housings on the operator side of each individual stand of a tandem stand group or continuous train for changing the rolls, and by additionally providing the roll set already with the guide fittings in accordance with the present invention, the exchange of the roll sets with the fixedly integrated guide fittings can be carried out substantially simpler and safer. This is because, as soon as the roll housings are placed on the shifting platform, it is merely necessary to release the chock holding flaps, so that the roll sets can be placed on the shifting platform onto the exchange carriages which have simultaneously been moved out of the stand. After the roll housings have been moved down from the shifting platform, the new roll sets previously made available on the shifting platform can be moved into position for reequipping the stands by an appropriate displacement of the platform.

In addition to the fact that the separate assembly of the guide fittings as it is known in the prior art described above is not required in accordance with the present invention, the fact that the fittings are mounted on the roll sets makes it possible to carry out a complete examination already during the preassembly. In this connection, it makes no difference whether the individual stands of the tandem stand group are constructed as two-high stands or have horizontal roll sets and vertical sets; in addition, instead of using three universal stands, the stand group could also be composed of two universal with an edging stand in the middle between the two universal stands. In that case, the edging stand is also provided with a roll housing on the operator side which can be moved away, so that the edging stand also does not have to be completely moved out of the rolling line. When the exchange is carried out, such a large amount of free space is made available that web guides can be used in a universal stand which have a greater length than the conventional length.

In accordance with a preferred proposal of the present invention, guide holders screwed to the roll chocks are connected in an articulated manner to the fittings.

For this purpose, in accordance with a further development of the present invention, the fittings are each screwed to a rest bar constructed with articulated fitting bearings, wherein the rest bar is arranged as a bridging member between two guide holders which face each other. Consequently, during the preassembly of the roll set, the rest bars merely have to be placed in the guide holders which have been screwed on in order to complete the roll set as a unit with the guide fittings.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
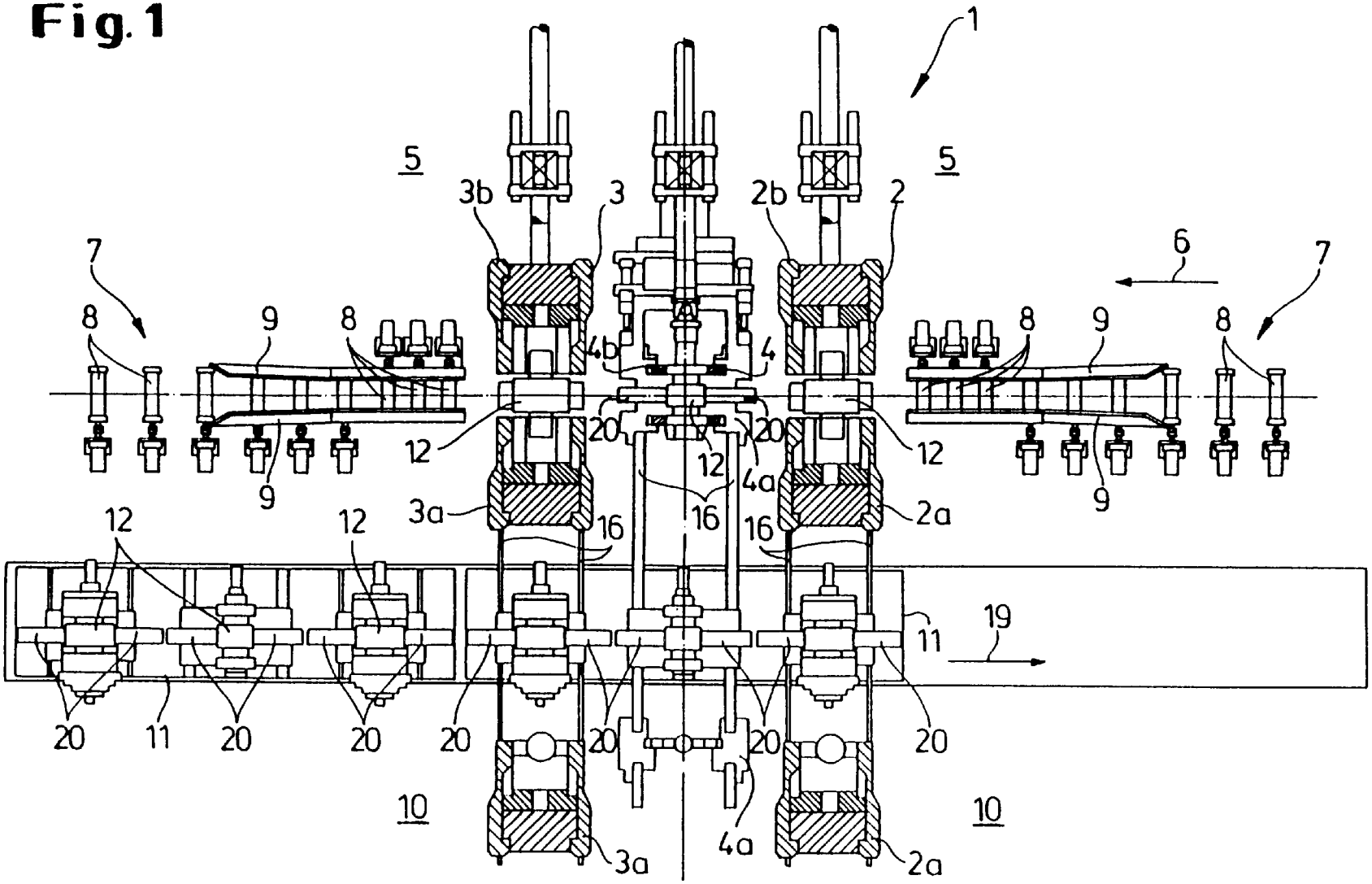
FIG. 1 is a top view of a complete tandem stand group, wherein the individual stands of the group have roll housings on the operator side which can be moved away, and wherein a shifting platform is arranged at the roll stands on the operator side.

In the embodiment illustrated in FIG. 1, a rolling train 1 is composed of three individual stands, wherein the two outer stands are universal stands 2 and 3 and the middle stand is an edging stand 4. On the drive side 5, the roll stands 2, 3 and 4 are connected to drives which are well known in the art and are not illustrated in detail. Roller tables 7 with driven roller table rollers 8 and centering guide members 9 arranged on the roller tables are mounted in front of the front universal stand 2 and following the rear universal stand 3, as seen in rolling direction 6. A shifting platform 11 for exchanging the roll sets 12 of the stands 2, 3 and 4 of the rolling train 1 is located on the operator side 10 so as to be moveable in rolling direction 6 and against rolling direction 6.

Figure 6:
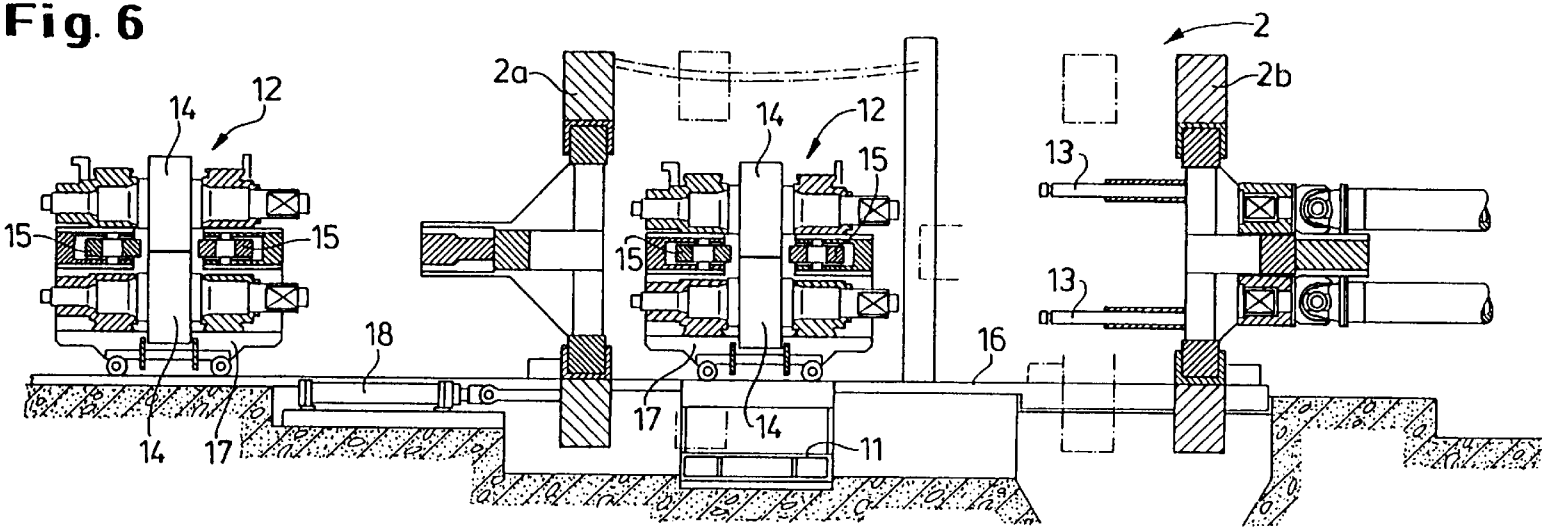
FIG. 6 is a partial cross-sectional view of the roll stand of FIG. 5.
Figure 5:
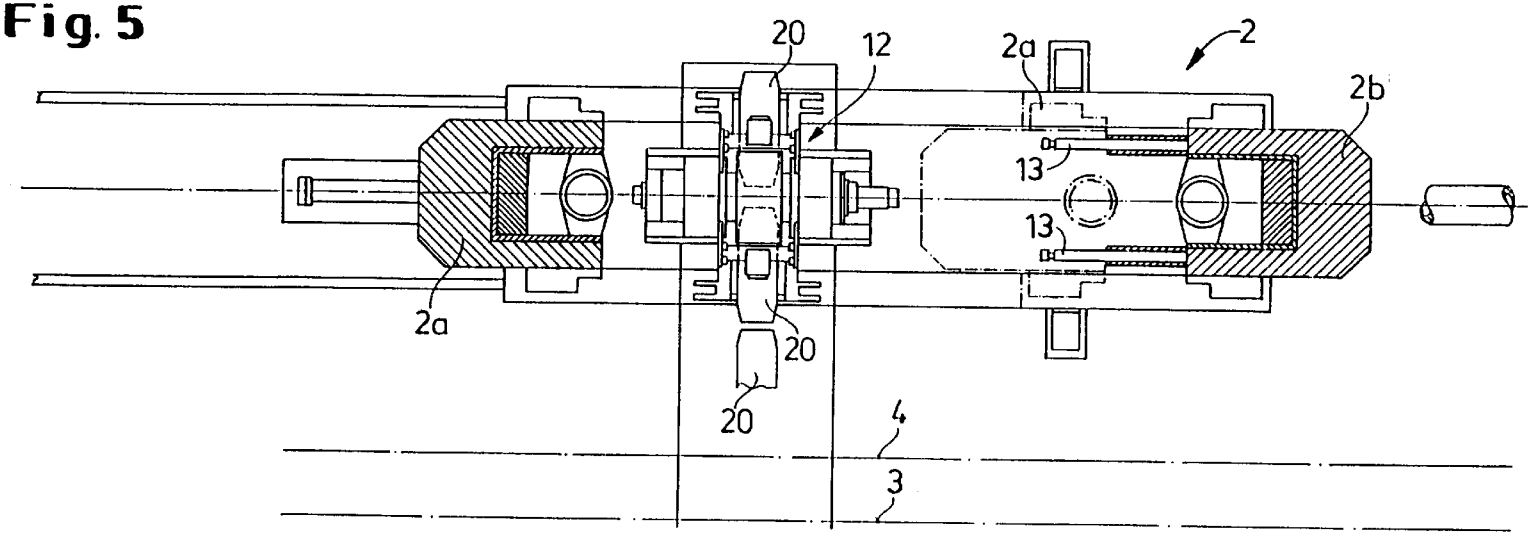
FIG. 5 is a top view, partially in section of a moved-apart roll stand of the tandem stand group of FIG. 1.

For exchanging the roll sets 12, the universal stands 2 and 3 and the edging stand 4 are provided with roll housings 2*a*, 3*a* and 4*a*, respectively, which can be moved away on the operator side 10, as illustrated in detail in FIGS. 5 and 6 in connection with the universal stand 2. During operation, the stationary roll housings 2*b*, 3*b* and 4*b* on the drive side are clamped to the removable roll housings 2*a*, 3*a*, 4*a* through four tie rods 13. Of course, for removing the roll sets 12, these hydraulically pretensioned tie rods which connect the two roll housings 2*a*, 2*b* or 3*a*, 3*b* or 4*a*, 4*b* with each other are released because in this position the roll housings 2*a*, 3*a*, 4*a* on the operator side can be moved away from the stationary roll housings 2*b*, 3*b*, 4*b* into the position shown in FIGS. 5 and 6; this is effected by means of shifting cylinders 18 acting on the roll housings 2*a*, 3*a*, 4*a* on the operator side. When they are being moved away, the roll housings 2*a*, 3*a*, 4*a* on the operator side travel onto the shifting platform 11 where the roll sets 12 come to rest on the exchange carriages 17 which are moveable on rails 16.

As soon as the roll sets 12 with the exchange carriages 17 are secured in their positions on the shifting platform 11, the roll housings 2*a*, 3*a*, 4*a* on the operator side are moved from the shifting platform 11, as illustrated in FIG. 1. Subsequently, it is merely necessary to move into position the new roll sets 12 previously placed on the shifting platform 11 on the left as shown in FIG. 1; for this purpose, the shifting platform 11 is moved in the direction of arrow 19 to such an extent until the new roll sets are in alignment for assembly in front of the roll stands 2, 3 and 4. The assembly is then carried out in the reverse sequence, i.e., the roll housings 2*a*, 3*a* and 4*a* on the operator side are then again moved onto the shifting platform 11 where they are locked to the new roll sets 12 which have been made available on the exchange carriages 17 and are then placed again into the closed stand position shown in FIG. 1 in which they are clamped by means of the hydraulically pretensioned tie rods 13 to the stationary roll housings 2*b*, 3*b* and 4*b*.

However, the roll exchange described above not only exchanges the rolls but simultaneously also the guide fittings or web guides 20 of the universal stands 2, 3, which in FIG. 1 are illustrated without these guide fittings for simplicity's sake, and of the edging stand 4; this is because the guide fittings 20 are components fixedly connected to the roll set 12, i.e., the roll set 12 and the guide fittings 20 constitute a unit.

Figure 2:
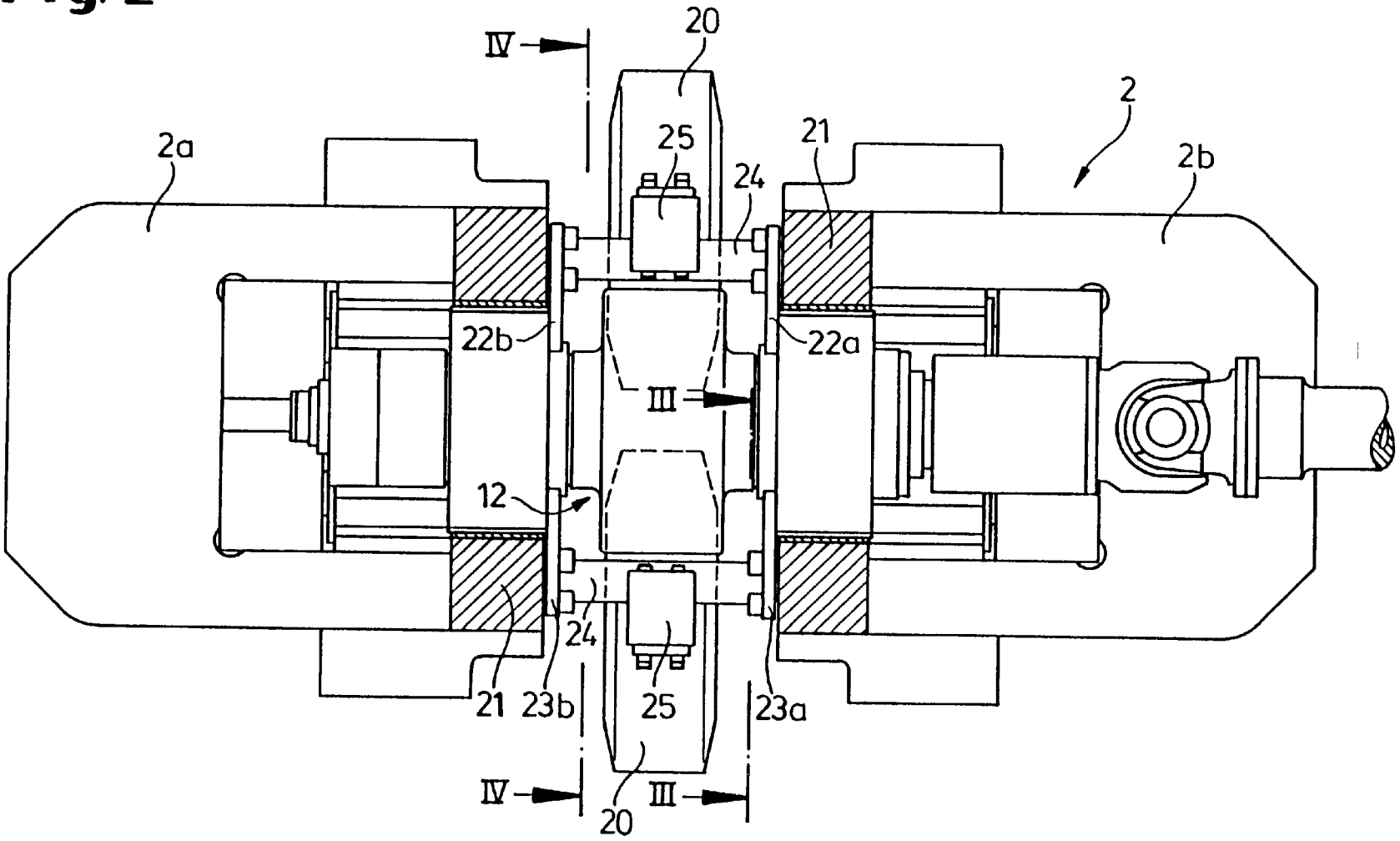
FIG. 2 is top view of an individual stand of the tandem stand group of FIG. 1, wherein the roll housings are shown partially in sections.
Figure 4:
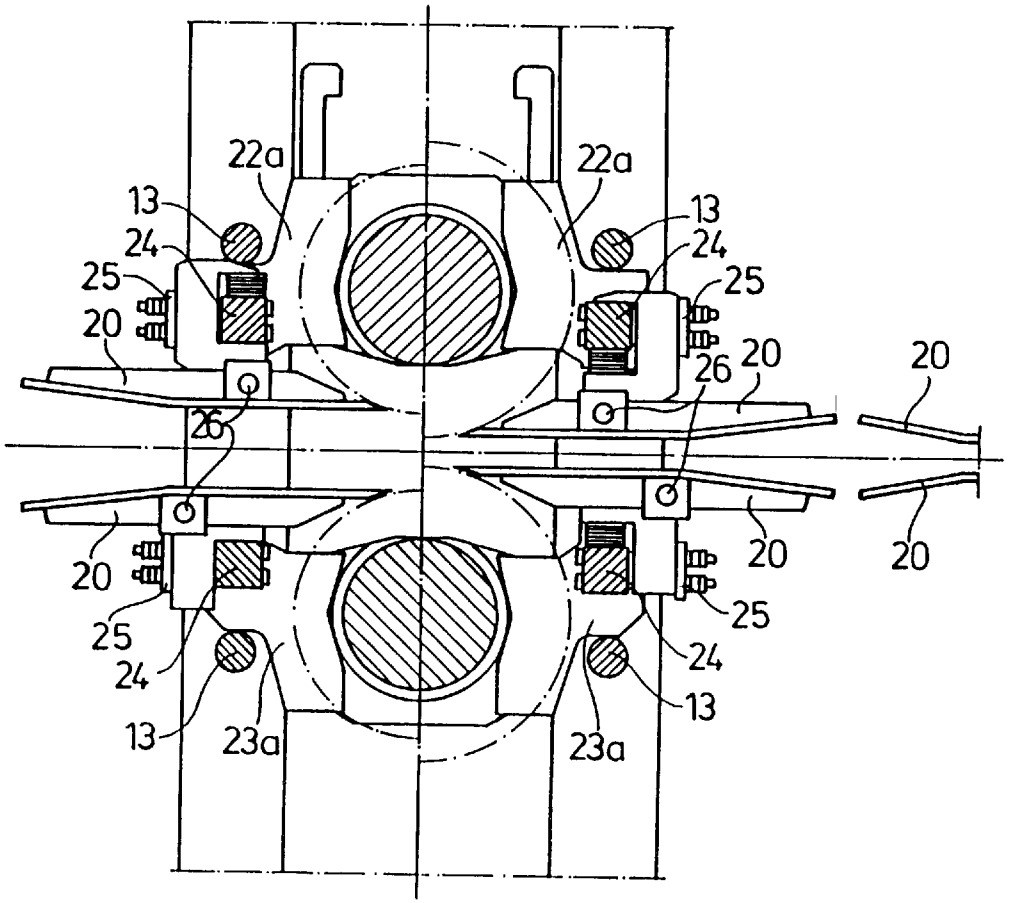
FIG. 4 is a sectional view taken along sectional line IV—IV in FIG. 2.
Figure 3:
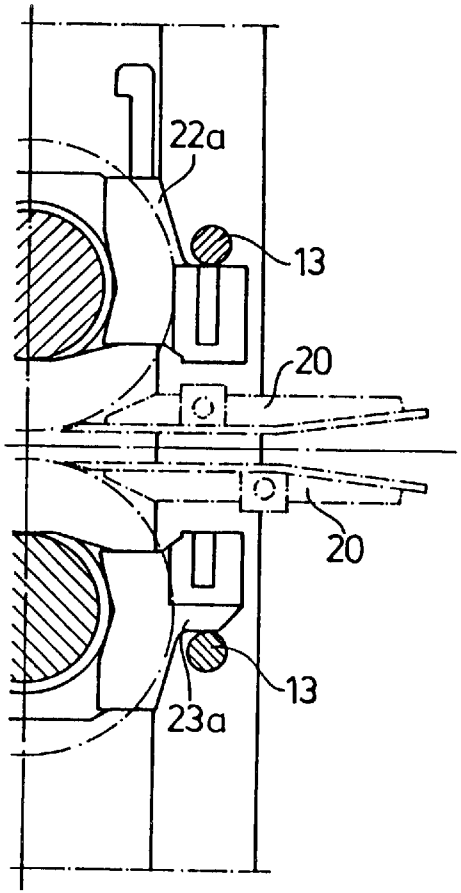
FIG. 3 is a sectional view of the roll stand taken along section line III—III in FIG. 2.

As can be seen in FIGS. 2 to 4, guide holders 22*a*, 22*b* or 23*a*, 23*b* are screwed to the chocks 21 of the roll sets 12, wherein always two oppositely located holders 22*a*, 22*b* and 23*a*, 23*b* receive a rest bar 24. The rest bar 24 supports a screwed-on component 25 which is provided through articulated fitting bearings 26 with the guide fittings 20. Guide fittings 20 for different roll diameters are shown in the left half and the right half of the drawing of FIG. 4, wherein, of course, a changeover to another roll diameter also requires an exchange of the roll sets 12, in the same manner as the exchange of the rolls due to wear.

While specific embodiments of the invention have been shown and described in detail to illustrate the inventive principles, it will be understood that the invention may be embodied otherwise without departing from such principles.

We claim:

1. A rolling train, particularly tandem stand group, comprising three roll stands each having a roll housing on an operator side and being equipped with roll sets and guide fittings connected to the roll sets, a shifting platform arranged on an operator side and exchange carriages moveable for exchanging rolls, the guide fittings connected to the roll sets being configured to be moveable out of a rolling line as a unit together with the roll housings on the operator side of the three roll stands.

2. The rolling train according to claim 1, wherein the three roll stands include two universal stands and an edging stand between the two universal stands.

3. The rolling train according to claim 1, further comprising guide holders screwed onto roll chocks of the roll stands, wherein the guide holders are connected in an articulated manner to the fittings.

4. The rolling train according to claim 3, wherein the fittings are each screwed to a rest bar comprising articulated fitting bearings, the rest bar being mounted as a bridging member between two guide holders which face each other.

* * * * *